US011577889B2

(12) United States Patent
Steenari

(10) Patent No.: US 11,577,889 B2
(45) Date of Patent: Feb. 14, 2023

(54) BEVERAGE CONTAINER AUTOMATED SPOUTS AND RELATED METHODS

(71) Applicant: Takeya USA Corporation, Costa Mesa, CA (US)

(72) Inventor: Jukka Steenari, Aliso Viejo, CA (US)

(73) Assignee: Takeya USA Corporation, Costa Mesa, CA (US)

( * ) Notice: Subject to any disclaimer, the term of this patent is extended or adjusted under 35 U.S.C. 154(b) by 54 days.

(21) Appl. No.: 17/091,882

(22) Filed: Nov. 6, 2020

(65) Prior Publication Data

US 2021/0139207 A1 May 13, 2021

Related U.S. Application Data

(60) Provisional application No. 62/932,386, filed on Nov. 7, 2019.

(51) Int. Cl.
*B65D 47/06* (2006.01)
*B65D 47/12* (2006.01)

(52) U.S. Cl.
CPC ..... *B65D 47/065* (2013.01); *B65D 47/123* (2013.01)

(58) Field of Classification Search
CPC ..... B65D 51/24; B65D 47/04; B65D 47/065; B65D 47/123; B65D 83/262; G07C 9/00182; A47K 5/1217
USPC ..... 222/52, 54, 63
See application file for complete search history.

(56) References Cited

U.S. PATENT DOCUMENTS

2015/0284163 A1* 10/2015 Manwani ..... B65D 23/02 222/572
2018/0305091 A1* 10/2018 Krafft ..... A47G 19/2272
2021/0127873 A1* 5/2021 Lawson ..... A47G 19/2272
2021/0188501 A1* 6/2021 Krafft ..... B65D 47/04

* cited by examiner

*Primary Examiner* — Vishal Pancholi
*Assistant Examiner* — Robert K Nichols, II
(74) *Attorney, Agent, or Firm* — KOS IP Law LLP

(57) ABSTRACT

A cap for a container, such as a water bottle, includes a spout, a state sensor, and an actuator that moves the spout between an open position and a closed position when the state sensor senses a state change for the cap. When a state change is sensed, for example when the container is tilted by a threshold amount, or when a pressure within the container has increased by a threshold amount, an actuator automatically moves the spout between an open position and a closed position. The control mechanism could also track use data, such as how many times the spout has been open/closed, or how much liquid has traveled through the spout.

14 Claims, 4 Drawing Sheets

BEVERAGE CONTAINER AUTOMATED SPOUTS AND RELATED METHODS

CROSS-REFERENCE TO RELATED APPLICATIONS

This application Claims Priority to the U.S. Provisional Application No. 62/932,386, filed Nov. 7, 2019, the subject matter of which is hereby incorporated by reference in its entirety as if set forth herein.

FIELD OF THE INVENTION

The present invention relates to beverage containers. More particularly, embodiments of the invention relate to a cap for a beverage container with electronics for data analytics and automated operations, among others.

BACKGROUND

Beverage containers, such as water bottles and sports bottles, are a common accessory for carrying a beverage. To use such beverage containers, a user would need to hold the container with one hand and open and close the container cap or lid with another hand, for example by unscrewing a cap or by opening a spout with one hand while holding the main body of the beverage container or vessel with another hand. This makes the container difficult to use when the user does not have simultaneous use of both hands, such as when the user is riding a bicycle or is carrying an object. While some beverage containers have spouts that can be opened with a user's mouth, such as with straws that a user can bite to open, or a spigot that can be bitten and pulled open with a user's mouth, such spouts can cause trauma and strain to a user's mandibles and are uncomfortable to use.

BRIEF SUMMARY OF THE INVENTION

A beverage container, such as a water bottle, includes a cap that is configured to automatically open and close in response to a detected state change to the cap, for example when the beverage container is tilted from a level state to a tilted state. The container could be any suitable shape to hold a beverage, and has an opening, such as a top side or a wall of the container, configured to couple with the cap. The cap couples with the opening of the container to enclose a liquid in the container, for example by fitting over the opening or by fitting within the opening. The cap generally includes a spout, a flow path, a liquid intake, a coupling mechanism, an actuator, and a state sensor.

The spout of the cap is typically fluidly coupled to a liquid intake of the cap via a flow path. The intake spout is configured to receive fluid from the opening of the container. The spout can have a movable mechanism (i.e. a hinge, a moveable projection, a door, a gate) that allows the spout to be moved between a closed position that seals the flow path and an open position that allows liquid to flow through the flow path. In one embodiment, in the closed position, the spout could be configured to be disposed within inside a spout enclosure in the cap to seal and seal an output end of the flow path. In the open position, the spout could be configured to extend out of the spout enclosure in the cap to allow liquid to flow from the container opening to the spout via the flow path. In such embodiments, the spout could have an opening to a throughput in the spout that aligns with the flow path in the open position and does not align with the flow path in the closed position. In some embodiments, a spout could be affixed or integral to the cap and could protrude out of a top surface of the cap. Such a spout could be closed by placing a cover over an opening of the spout. Still other containers could have spouts that either slide out or telescope out of the spout enclosure to open the flow path, and slide back or telescope back into the spout enclosure when not in use to seal the flow path. In some embodiments, the spout could have a locking mechanism that holds a spout in a closed position or holds a spout in an open position for a period of time.

The flow path of the cap provides a path through the cap from a liquid intake of the cap to the spout of the cap. The flow path could include an outlet that has an opening defined on or proximate a top surface of the cap and a liquid inlet that has an opening on or through a bottom surface of the cap. The liquid inlet may comprise a defined shaft that extends out of the bottom surface of the spout as a part of the liquid intake of the container, or could be fluidly coupled to a shaft that extends from the cap into the opening of the container. In some embodiments, the flow path comprises a conduit, such as a straw, that extends into an opening of the container to pull liquid from areas within the container.

The liquid intake of the cap could comprise an opening of the flow path that has an inlet proximate the junction between the cap and the container. In some embodiments, such as a cap for a water bottle, the liquid intake could be coupled to the container at an opening at the top of the container, whereas in other embodiments, such as a spigot for a keg, the liquid intake could be coupled to the container at an opening closer to the bottom of the container to allow for liquid to flow into the flow path of the cap from the opening without needing to tip the container. In some embodiments, the liquid intake could comprise a straw that couples the flow path to an opening in the container. In some other instances, the liquid intake could comprise a shaft integral to the flow path and/or cap that protrudes out of the bottom of the cap which is configured to penetrate into the opening of the container by a distance when the cap is coupled to the container.

A coupling mechanism of the cap could affix the cap to the container. In some embodiments, the coupling mechanism could cover a surface of the opening, such as a threading on an outer sidewall of the opening that matches a threading on the inner sidewall of a bottom recess of a cap. Such threading could be used to screw the cap onto the container to provide a liquid-tight seal between the opening of the container and the liquid intake of the cap. In other embodiments, the coupling could comprise a male connector configured to mate with a female connector of the container, or vice-versa, which is configured to open a valve of the container upon mating. In other embodiments, the cap could be affixed to a side of the container via a hinge, and could comprise a locking mechanism on a side of the cap without the hinge. Such a cap could open and close by rotating about the hinge with the locking mechanism holding the cap in place in the closed position.

An actuator powered by a power source, such as a battery, could be utilized to move a spout of the cap between an open position and a closed position. In embodiments where the spout comprises a rotating spigot, the actuator could comprise a motor that moves the spout between an orientation perpendicular to the flow path (which blocks the flow path) and an orientation aligned with the flow path (which allows liquid from the container to flow out the spout via the flow path). In some embodiments, the actuator could comprise an electronic motor powered by a power supply that rotates, pushes, pulls, or extends the spout between the open position and the closed position.

A state sensor could be utilized to transmit a state change signal to a control device when the state sensor detects a state change. In some embodiments, the state sensor can transmit a binary signal, such as an open state change signal and a close state change signal, while in other embodiments the state sensor can transmit a digital or analog signal having a plurality of possible values. The state sensor could be configured to transmit one or more signals to a control device that then provides commands to the actuator as a function of the received signal. The signal from the state sensor can be used to trigger the actuator to move the spout of the cap between positions, such as the open and closed positions, when the state sensor senses a state change of a portion of the cap. The state sensor could be configured to sense a change of state in any suitable manner. For example, the state sensor could comprise an accelerometer or a motion sensor that changes state when a portion of the cap is tilted from a reference axis, such as a horizontal or vertical axis, by more or less than a threshold amount. Such accelerometers could be configured to allow a cap for a container, such as a water bottle, to automatically open when the water bottle is tilted from an upright position and automatically close when the water bottle is tilted to an upright position. In another embodiment the state sensor could comprise a pressure sensor that measures an air pressure at or about the liquid intake of the cap. Such a pressure sensor could be configured to activate an actuator to automatically open the spout when the pressure sensor detects the air pressure exceed a given threshold or increase by a given threshold within a period of time. For containers that have a flexible wall, such a state sensor could automatically open a cap when a user squeezes the wall of the container, and automatically close when the user ceases to apply pressure to the wall of the container.

A volume sensor could be utilized to measure a volume of liquid that flows through the flow path from the liquid intake to an opening of the spout. Any suitable volume sensor could be utilized, for example a piezoelectric sensor that measures a pressure of a liquid flowing through a portion of the cap, or a timer that measures a time a liquid that travels through a portion of the flow path of the cap. Such a volume sensor could transmit data to a control module, such as a computer processor, to track the amount of liquid that flows through the cap.

A computer processor executing software instructions on a memory of the cap could be integrated into the cap to perform simple logic, such as calculating how many times a spout of a cap has been opened and/or closed, or by calculating how much liquid has traveled through the cap based upon a metric received by a volume sensor. Such values could be saved or added to a persistent memory that holds historical data, such as a use tally that increments when a spout is opened and/or closed, or a volume tally that increments when a volume of liquid flowing through a cap has been calculated. Preferably, the cap has a user interface that could be used to reset a memory value, such as a button that could be pressed to reset a use tally or a volume tally.

In some embodiments, the cap could also comprise a switch that activates and deactivates an element of the cap, for example the state sensor, actuator, or the processor itself, which would activate or deactivate the ability for the cap to automatically open and close the spout. For example, the switch could comprise a fingerprint sensor that activates the state sensor when the fingerprint scanner recognizes a fingerprint, or that deactivates the state sensor when the fingerprint scanner does not recognize the fingerprint.

DETAILED DESCRIPTION

Figure 2:
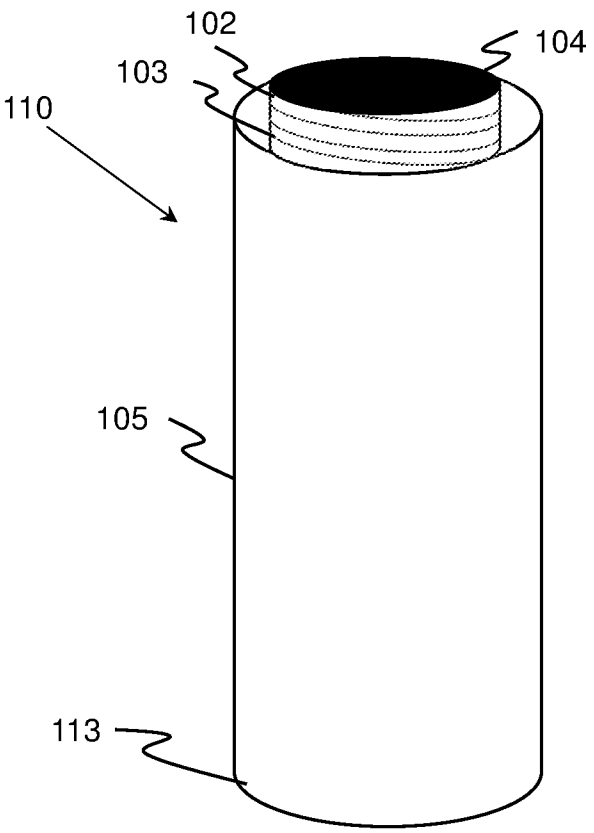
FIG. 2 illustrates a perspective view of a beverage container cap in accordance with an embodiment of the invention.
Figure 1:
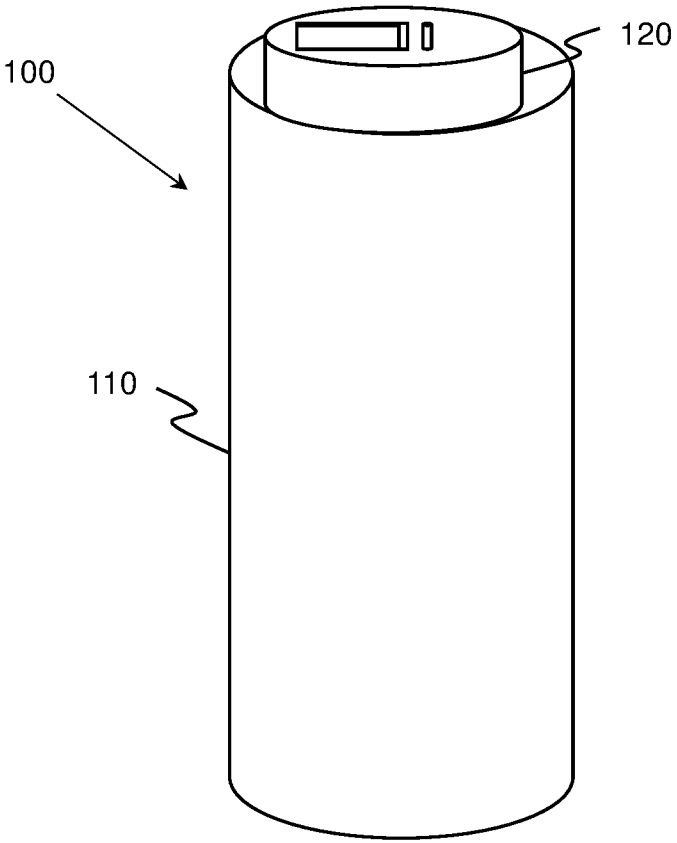
FIG. 1 illustrates a beverage container in accordance with an embodiment of the invention.
Figure 3:
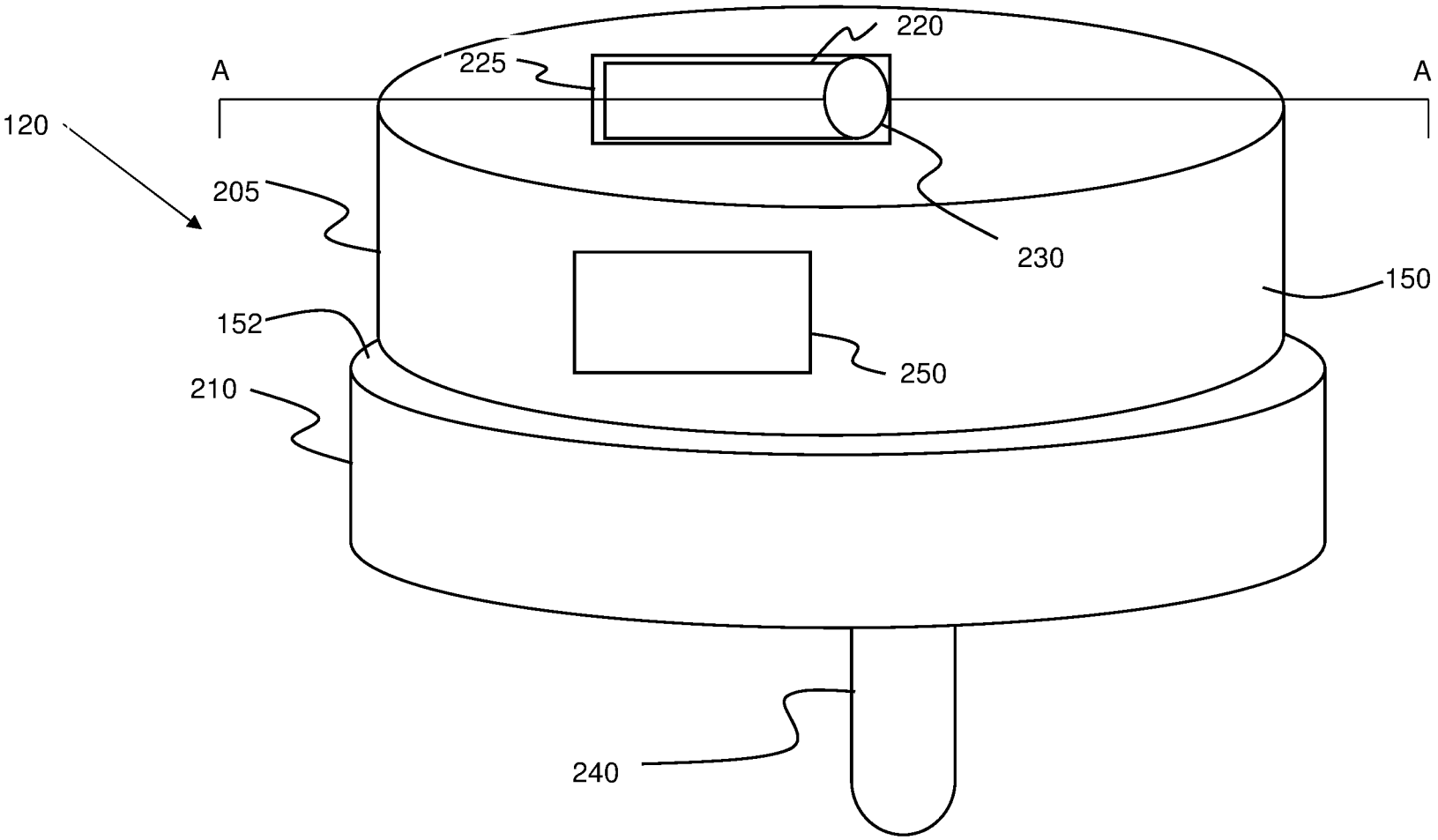
FIG. 3 illustrates a cross sectional view of the beverage container cap shown in FIG. 2 along line A.
Figure 4:
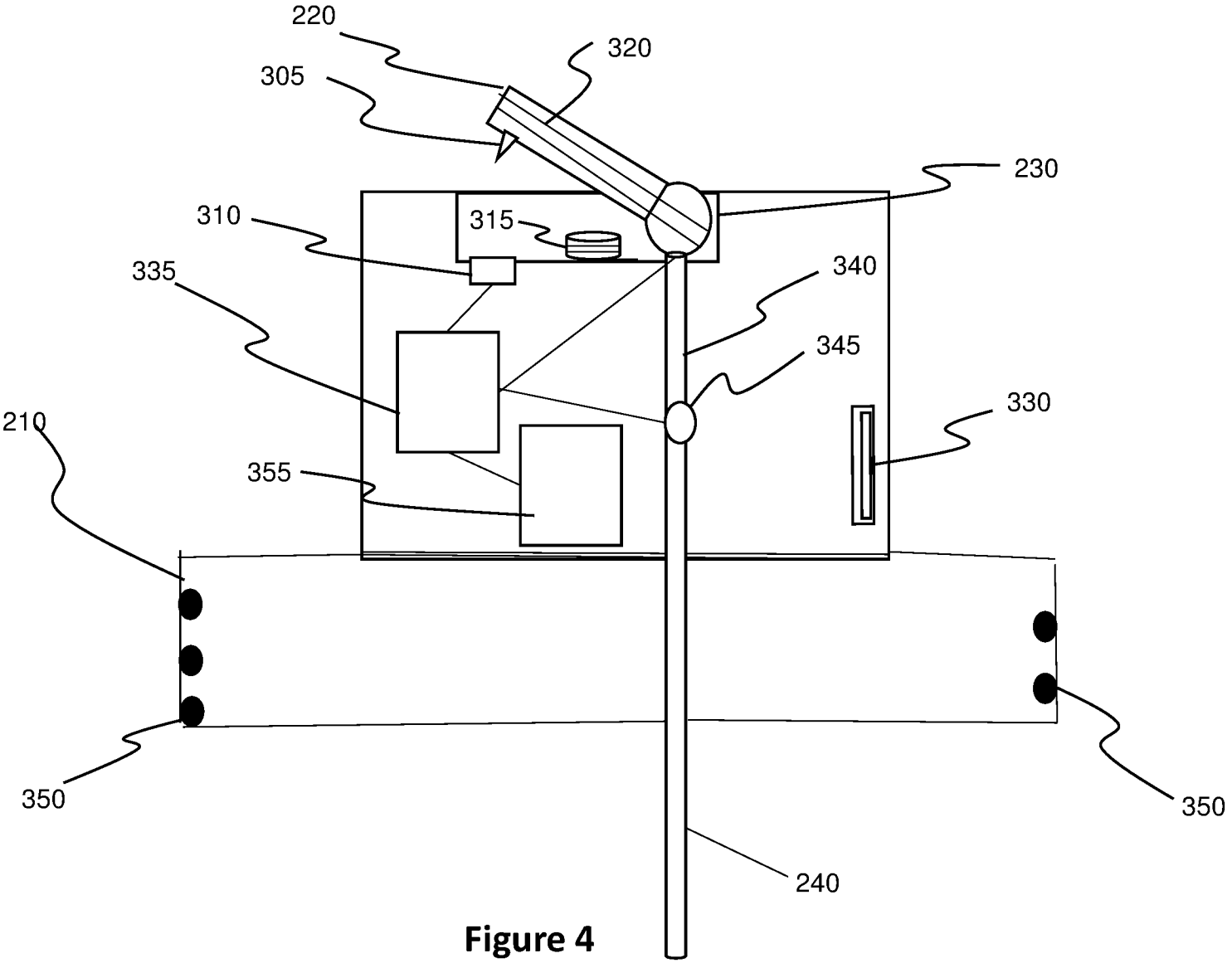
FIG. 4 illustrates a schematic of a beverage container in communication with distal electronic devices.

FIG. 1 shows an exemplary container apparatus 100 having a container or vessel 110, shown in more detail in FIG. 2, and a cap or lid 120, shown in more detail in FIGS. 3 and 4, in accordance with an embodiment of the invention. The container or vessel 110 could be configured to hold any material or combination of materials where a portion of the fluid within the container 110 may flow out the opening 104 of the container 110, such as a fluid beverage having solid frozen ice cubes mixed within the fluid, or a viscous smoothie beverage comprising solid and liquid particulate matter, in addition to a fully liquid beverage such as juice or water. The vessel 110 can embody any number of sizes, shapes, and materials, including different exterior surface finishes. In one embodiment, the vessel is a single shell metal or thermoplastic container, such as a single shell stainless steel or plastic container. In other examples, the vessel 110 can embody a two-layer container, also known as a vacuum-insulated stainless steel bottle or container.

The cap 120 covers the opening 104 of the container 110, and couples to the lip 102 of the container 110 to provide a liquid-tight seal between the cap 120 and the container 110, at the interface thereof. Such a liquid-tight seal prevents a beverage stored within the cavity of the container 110 from flowing out of the opening 104 when the cap 120 is coupled to lip 102 of the container 110, no matter what the orientation of the container 110. Thus, when the container apparatus 100 is not upright, for example when the container apparatus 100 is flipped upside-down, the liquid-tight seal between the cap 120 and the container 110 prevents liquid from pouring out the opening 104.

FIG. 2 shows an isolated, perspective view of the container 110 disconnected from the cap 120. The container 110 has a wall 105 with an exterior and an interior, wherein the interior defines an interior cavity or holding space. For a vacuum-insulated bottle or container, the interior of the outer shell faces the exterior of the inner shell and the interior of the inner shell defines an interior cavity or holding space for holding a volume of consumable liquid or product. For discussion purposes, the wall 105 of the container is described as a single shell wall, however, in some embodiments a container may have multiple layers of walls, or may have a plurality of walls that are coupled together to form a shell to form a holding space.

The wall 105 transitions to a lip 102 having an opening 104 disposed on a top surface of the container 110. When the container 110 is tilted on its side, a portion of a beverage stored in the cavity of the container 110 can flow out the opening 104 if the cap 120 is not coupled to the container 110. While the container 110 is shown as having cylindrical walls 105, the container 110 could have any volumetric shape having a cavity to hold a beverage with an opening, such as, but not limited to, rectangular, prism-shaped, bag-shaped, ovoid, pyramidal, spherical, irregular, and shapes of various characters and/or vehicles. In an example, the diameter of the lip 102 is the same across several difference sized vessels so that the same cap or lid can be used across different sized vessels. In still other examples, a rubber or silicone sleeve (not shown) may be coupled to the closed end or bottom end 113 of the vessel. The sleeve can stretch over and grip the bottom end 113 and may be used to cushion the vessel 110 upon placement of the vessel onto a surface, such as to avoid scratching the vessel and/or surface and to reduce banging sound.

While the opening 104 is disposed on a top surface of the container 110, an opening configured to couple with a cap could be disposed on any suitable side of a container, such as a side surface or a bottom surface of the container. In one embodiment, the opening 104 could comprise a side tap of a barrel container having a cap comprising a spigot that is configured to open and close to allow liquids within the container to flow out of the spigot when the spigot is opened.

The lip 102 can have a cylindrical wall 102 having exterior threads 103 to mate with interior threads 350 of the cap 120 (FIG. 4). Such threading allows the cap 120 and the container 110 to form a liquid-tight seal when the cap 120 is fully tightened onto the threading of the lip 102. The cap 120 may include one or more washers to be pressed between the cap and the upper rim of the lip 102 to improve sealing. While the cylindrical wall of the lip 102 having the opening 104 is shown having a threading 103 that forms a liquid-tight seal between the container 110 and the cap 120 having a counter-part threading 350, other coupling mechanisms could be used, such as reversed thread arrangements with the cap having external threads and the lip 102 having internal threads, a male-female connector having a female connector with a valve that is opened and pierced by the male connector, or a Quillfeldt stopper connector having a flip-top and a biased lever could be used.

The coupling mechanism between the lip 102 having the opening 104 of the container 110 and the cap 120 forms a liquid-tight seal that prevents liquid from leaking from any portion of the coupling mechanism when liquid flows from the cavity in the container 110 to the spout 220 (FIG. 3) of the cap 120 for dispensing. While the lip 102 of the vessel is shown as a cylindrical opening, the lip 102 could comprise any shape suitable to mate with a cap such that the lip 102 and the cap 120 are able to couple and mate with one another such that liquid can flow from the container 110 to the cap via the opening 104. Once the cap 120 is coupled to the lip 102 via the coupling mechanism (shown here as matching threads 103 and 350 on the cap 120 and the opening 104), liquid in the cavity of the container can only leave the opening 104 when the spout 220 is opened.

FIG. 3 shows an isolated, perspective view of the cap 120 disconnected from the container 110 while FIG. 4 shows a cross-sectional view of the cap 120 along line A-A shown in FIG. 3, with the spout 320 partially rotated. The cap 120 has a cap body or body 150 that includes a base 205 and a coupling skirt 210. The base 205 and the coupling skirt 210 have different outside diameters. In other examples, the two can have approximately the same diameter, without a step or shoulder therebetween. The base 205 includes the spout 220 and electronic circuitry for tracking, controlling and/or operating the spout 220, as further discussed below. The coupling skirt 210 can be generally hollow and is used as a coupling mechanism to couple to the lip 102 having the opening 104 of the container 110. The coupling skirt 210 extends from the bottom side or lower end of the base 205 and a shoulder or neck section 152, which has a corresponding shape in the interior of the cap. A threading, or interior threads, 305 are located or provided along the inner sidewall of the coupling skirt 210, as shown in the cross-sectional view of the cap in FIG. 4. The threading 305 on the inner sidewalls of coupling skirt 210 is configured to threadedly engage with the exterior threads on the lip 102 of the vessel to couple the cap 120 to the container 110. While the base 205 and the coupling skirt 210 are shown with two different diameters/widths in the disclosed embodiment, in other embodiments the base and the coupling skirt could comprise shapes having the same diameter/width, or the coupling skirt could have a diameter/width that is less than the diameter/width of the base.

The threading 350 is shown on an inner surface of a side wall of skirt coupling 210. Threading on the inner side wall of skirt coupling 210 of cap 120 couples to the threading on the outer surface of the container near the opening of the container to screw the cap 120 onto the container to seal the container. In some other embodiments, the cap may be affixed on one side to the top of the container by a hinge and have a locking mechanism on the other side of the cap. The cap opens and closes by rotating about the hinge with the locking mechanism holding the cap in place in a closed position.

A spout 220 is shown pivotally coupled to the spout enclosure 225 on a top surface of the base 205 by a hinge 230. The spout 220 is shown in a closed position in FIG. 3 and halfway between a closed and open position in FIG. 4. As shown, the spout 220 is configured to rotatably pivot to a closed position that seals the throughput 320 of the spout 220 from the flow path 3 of the cap 120. In an example, when the spout is rotated to the closed position, the throughput 320 of the spout 220 is prevented from aligning with the flow path 340 of the cap 120. In other examples, when the spout 220 is rotated to the closed position, the straw or liquid intake tube 240 is pinched, thus closing off fluid flow to the throughput 320. This prevents liquid from escaping from the container 110 if the container apparatus 100 is turned and the beverage inside the cavity of the container 110 flows towards the opening 104, such as if the container 110 is on its side or is upside-down. The spout 220 is configured to rotatably pivot to an open position to align the throughput 320 of the spout 220 with the flow path 340 of the cap 120 to allow fluid to flow between the throughput 320 of the spout 220 and the flow path 340 of the cap 120. In other examples, rotation of the spout 220 to the open position releases pressure placed on the straw 240 to no longer pinch the straw. In the open position, the output of the spout 220 is bent to extend from the spout enclosure 225 for use in pouring and/or drinking the liquid inside the container via the throughput 320 of the spout 220. When the spout 220 is in the open position, the opening of the throughput 320 at least partially aligns with the output of the flow path 340 of the cap 120 to allow liquid to flow from the flow path and through the spout. The spout 220 is connected to the cap 120 by a hinge 230. The spout 220 rotates about hinge 230 to move between the open and closed positions.

Spout 220 is shown in a partially open position in FIG. 4. Further rotation of the spout 220 to a vertical, or near vertical position, will more fully open the spout. In the open position, the spout 220 extends away from an upper surface of the cap 120 for use in pouring and/or drinking the liquid inside the water bottle. The spout 220 also has an opening to a throughput 320 inside spout 220 that at least partially aligns with the output of flow path 340 when the spout 220 is in the open position to allow liquid to flow from the flow path and through spout 220.

In addition, the spout 220 has a hook 305 on a bottom surface of the spout 220. The hook 305 is positioned such that the hook 305 enters a latching mechanism 310 when the spout 220 is rotated to a closed position. The latching mechanism 310 locks onto hook 305 to hold spout 220 in the closed position. In some examples, the hook 305 and the latching mechanism comprise reversible detents. An optional spring 315 may be incorporated. When incorporated, the spring 315 is in a coiled positioned when the spout 220 is in a closed position. When the latching mechanism 310 releases the hook 305, or when the hook 305 and the latching mechanism 310 separate, the spring 315 is allowed to uncoil, and its natural bias helps to push the spout 220 to the open position. In other embodiments, an electric motor may be used to rotate the spout 220 about the hinge 230 to move spout 220 between the open and closed positions.

While the spout 220 is shown as a rotatable spout that rotates between an open position where the throughput 320 aligns with the flow path 340 and a closed position where the throughput 320 does not align with the flow path 340. Other embodiments of spouts that can be moved between an open configuration and a closed configuration are contemplated. In some embodiments, the rotatable spout could pinch the straw 240 when the spout 220 is rotated to the closed position, and could not pinch the straw 240 when the spout 220 is rotated to the open position. For example, in accordance with some embodiments, the spout could be configured to be in a fixed configuration that protrudes outward from a surface of the cap, such as a short stub with a hollow bore opening to the interior of the cap, and could be closed by placing a cover over an opening of the spout, such as a door or gate powered by an actuator. For example, the door or gate could be connected to a linkage or a piston and the movement of the linkage or piston can be initiated by an actuator. In another example, the spout can be equipped with a ball valve that can be actuated to open and close. The ball valve can be made from a plastic material and the ball seat can be located within a flow path in the cap, such as the throughput 230 of the spout 220 or a portion of the flow path 340. In accordance with another embodiment, a water bottle container could have a spout that slides in and out of cap 120 between open and closed positions, where the spout has an opening in its throughput that at least partially aligns with the opening of the flow path when the spout is in the open position, and does not align at all with the opening of the flow path when the spout is in the closed position. In accordance with yet another embodiment, the spout could be configured to telescope between the open and closed positions within the spout enclosure, where the closed position seals an opening by virtue of the thickness of the overlapping walls sealing the opening of the flow path. In accordance with yet another embodiment, the spout may be configured to be in a fixed configuration and an electronically controllable valve may seal the flow path from the throughput in the closed position, and may open the flow path in the open position. The valve may be opened and closed to control the flow of liquid through the spout via an electronic actuator controlled by a processor. In still other example, the spout could be operated manually by a user of the container, such as by flipping the spout or by manually rotating a spout cap disposed to cover an opening of the spout, and the electronics discussed elsewhere herein could be utilized to track usage information about the container assembly, such as to track the number of times the container is tilted, the average time between container tilts, the length of time of each tilt, the number of times the spout is opened, etc.

In accordance with another embodiments, the spout is in a fixed configuration protruding outward from a surface of the cap and the spout is closed by placing a cover over at least an open end of the spout. In accordance with another embodiment, the spout uses a piston, a step motor, or a solenoid to slide between the open and closed position. In accordance with yet another embodiment, the spout could be configured to telescope between the open and closed position within the spout enclosure using a piston, step motor, or solenoid.

The flow path 340 could be configured to provide a liquid connection through cap 120 from liquid intake or the liquid intake 240 to the spout 220. The flow path 340 includes an outlet opening defined on or proximate the top surface of cap 120 within the spout enclosure 225 and an inlet opening defined on or through a bottom surface of cap 120. The flow path 340 comprises a conduit through the cap 120 and is in liquid connection with the throughput 320 of the cap 120

The liquid intake 240 can be a straw or tube having a length and a lumen. The liquid intake 240 is shown extending from the bottom surface of cap 120. In an example, an open end of the liquid intake 240 can project into a boss at the wall of the cap. The liquid intake 240 can be an extension of the flow path that protrudes into the body of the container 110, when the cap 120 engages the container 110, and defines a conduit or a flow path that has an inlet opening or inlet end located below the opening 104 of the container 110, near the closed end 113 of the container. In some embodiments, the liquid intake 240 could be configured to extend to a location proximate the bottom of the container to allow more liquid in the container to be consumed without the need to substantially tilt the container. The liquid intake 240 can be integral to an internal flow path. In some other embodiments, the liquid intake could comprise a straw that couples to an outlet end of the flow path. In some embodiments, a liquid intake conduit is not used, and the bottom of the cap 120 could simply comprise a flow path having an opening that is fluidly coupled to the opening 104 of the container 110.

The liquid intake 240 is an extension of the flow path 340 and defines a flow path that has an inlet proximate the bottom of the container. The inlet end of the liquid intake 240 is at or proximate the bottom of the container and receives liquid from a point closer to the bottom of the container to allow more liquid in the container to be consumed. In FIG. 3, liquid intake is integral to flow path 240 and/or cap 120. In accordance with some other embodiments, liquid intake 240 is a straw that couples to an inlet of flow path 340 at or proximate a bottom surface of cap 120. In accordance with some embodiments, flow path 340 terminates at the opening into flow path 240 through the cap.

The cap 120 can include one or more sensors 250. In an example, the sensor 250 can be mounted externally to the cap and accessible externally by the user. As shown, the sensor can be a touch sensor that is configured to detect a biometric feature, such as a fingerprint scanner that scans a finger print of a user when a finger or other body part touch and/or is held proximate the sensor, or a body heat sensor that senses a temperature from a user. In embodiments where the sensor 250 comprises a body heat sensor, the sensor 250 could transmit a signal to a control system, such as the control system 335, when the sensor senses body heat over a threshold temperature within a threshold proximity of the body heat sensor. Other types of proximity sensors could be used, for example inductive, capacitive, photoelectric, and ultrasonic sensors. In another example, the sensor 250 could comprise a simple mechanical switch that can be pushed or flipped between an on and off position to activate features of the container apparatus 100, and specifically of the cap 120. Although the sensor 250 is shown located on a side wall of the base 205, the sensor 250 may be disposed anywhere on a surface of the cap 120 in accordance with other embodiments of the invention. When a registered user touches the touch sensor 250, the a signal sensed fingerprint could be transmitted to a control system 335 (FIG. 4), such as one located inside the cap 120, that can then activate a motor or actuator to rotate the spout 220 from the open position to the closed position, or vice-versa, as explained in further detail below.

The cap 120 can include one or more additional sensors 355 mounted to the interior of the cap 120. For example, a motion sensor 355 can be mounted to, or integrated into, the cap, for example to the interior of the cap. The motion sensor 355 can detect when cap 120 is tilted. In accordance with some embodiments, the motion sensor 355 could be an accelerometer that detects an amount that cap 120 is tilted from an axis, such as the horizontal plane. In accordance with another embodiment, the motion sensor 355 detects the rate at which cap 120 is being tilted. Contemplated motion sensors include a gyroscope, an accelerometer, Inertial Measurement Unit (IMU), a 3-axis accelerometer and a 9-axis IMU that includes a 3-axis gyroscope, a 3-axis accelerometer, and a 3-axis compass.

A control system 335 can be provided with the cap 120, such as mounted to an interior of the cap 120. The control system 335 can be communicatively connected to the motion sensor 355 to receive measurement signals from the motion sensor 355. The control system 355 can use the measurement signals to determine when the water bottle is being tilted to obtain liquid. In some examples, the control system 355 can distinguish between a tilting motion that is representative of drinking motion and other tilting motions, such as when the water bottle tips over, when tossed on a sofa or back of the car, etc. In accordance with some embodiments, a determination that the water bottle is being tilted to obtain liquid, such as when taking a drink, is based upon the angle that cap 120 is tilted. In accordance with some other embodiments, the determination is based in part upon the rate of change in the angle of cap 120 in order to distinguish between a tilt to obtain liquid and a tilt caused by a dropping or jolting of the water bottle. In response to a determination of a tilt to obtain liquid, the control system 335 transmits signals to the latch mechanism 310 to cause latch mechanism 310 to release the hook 305 thereby allowing the spout 220 to be pushed to the open position. In an example, the cap is without a motor or actuator to rotate the spout. Instead, upon releasing the latch mechanism from the hook, the spring 315 produces sufficient lifting force to rotate the spout 220 partially up to then allow the user to use his or her lips or mouth to more fully open the spout.

The control system 335 generally comprises a processor, a memory, and a power source, such as a rechargeable battery, which could be used to power any electronic device in the cap 120. The memory of the control system 335 comprises computer code that provides instructions for the control system 335, such as what signals could be used to activate an actuator to move the spout 220, when to increment a tally, when to reset a tally, when and how to transmit tally information, and what calculations could be used to calculate a tally. The memory of the control system 335 also preferably holds tally data that is collected and saved by the control system 335.

The cap 120 can include a flow device 345 coupled to the flow path 340. In an example, the flow device 345 can be a volume sensor that is in communication with the flow path 340 and measures a metric that could be used to calculate the flow of liquid through the flow path. In accordance with some embodiments, a portion of the flow device 345 could extend into the throughput 320 of the spout 220. The flow device 345 could comprise a flowmeter that directly measures an amount of liquid that flows through the flow path, or could comprise a sensor that measures another metric that could be used to calculate the flow of liquid, for example a piezoelectric sensor that measures a pressure of a liquid flowing through a portion of the cap, or a timer that measures a time a liquid travels through a portion of the flow path of the cap. In accordance with another embodiment, the volume sensor could also comprise a sensor for another property of the liquid in flow path 340 including, but not limited to temperature. The flow device 345 is communicatively connected to the control system 335 and transmits flow measurement signals to the control system 335. In accordance with some embodiments, the control system 335 includes a wireless transceiver for establishing a wireless connection with a computer device, for example a computer system, a server, or a mobile device, via a communication media and/or network. The control system 335 transmits the flow measurement signals and/or data derived from the signals to another device via a direct wireless connection or over a network using the wireless transceiver.

In another example, the flow device 345 could comprise a pump that draws liquid from the intake tube 240 towards the flow path 340 to the throughput 320 of the spout 220. The control system 335 could be configured to control the pump as a function of inputs it receives from sensors. The control system 335 could transmit a binary on/off control signal to such a pump as a function of one or more sensor inputs. In another embodiment the control system 335 could transmit a digital or analog range of signals to such a pump as a function of one or more sensor inputs. For example, where the control system receives a signal from the sensor 250 to activate the pump via a switch, the control system could activate the pump to draw liquid from the intake tube 240 towards the flow path 340 to exit the spout 220. In accordance with some embodiments, the pump may be controlled by the control system 335 that may adjust forced rate as a function of the tilt angle and/or motion rate detected for the cap 120. For example, where the control system receives a signal from the sensor 355 that the cap 120 has been tilted by an amount from a reference axis, the control system could activate the pump as a function of the amount that the cap 120 has been tilted. For example, at a first range of angles, the pump could activate at a first speed, at a second range of angles the pump could activate at a second speed, and at a third range of angles the pump could activate at a third speed. In accordance with some other embodiments, the pump may be activated when the spout is opened.

In some embodiments, the control system 335 could activate the actuator of the spout 220 and a pump of the flow device 345 as a function of different sensor signals. For example, the control system 335 could receive a fingerprint from the sensor 250 which, if authorized as a recognized fingerprint, the control system 335 transmits an open signal to the actuator to open the spout 220. Then, the control system 335 could receive a signal from the sensor 355 that the cap 120 has been tilted by more than a minimum threshold amount from a reference axis to activate the pump of the flow device 345, and the flow rate of the pump could be calculated as a function of the tilt angle. Once the control system 335 receives a signal from the sensor 355 that the cap 120 has a tilt angle of less than the minimum threshold amount, the control system 335 could then turn off the pump, transmit a signal to the actuator to close the spout 220, and could then save the amount of liquid pumped through the flow device 345 to an incremented volume tally and save the number of times the spout has been opened to an incremented use tally.

In an alternative example, instead of a pump, the flow device 345 could comprise a bladder that is pressurized to provide a source of pressure inside the bottle. Water or fluid can be held inside the bottle but outside of the bladder so that when the valve or spout of the cap is opened, pressure from the bladder moves fluid from within the container out the spout for a user to then intake. In still other examples, the fluid to be dispensed can be located inside the bladder, which is fluidly coupled to the liquid intake 240 and the pressure outside of the bladder is controlled by the control system 335 transmitting signals to a pump that increases pressure surrounding the bladder.

The cap 120 can include a power supply (Not shown) that provides power to the control system 335, the motion sensor 355, optional pump and/or flow measurement system 345. The interface 330 provides an external electronic connection to the cap 120. Preferably the interface 330 comprises an interface that allows both communication and power to the cap 120, such as a USB port, allowing a device to provide both power to the cap 120 and to communicate with the cap 120, for example by programming the cap 120, transmitting commands to the cap 120, or by retrieving tally data from the cap 120. In accordance with some embodiments, the power supply includes batteries and the interface is replaced with an access panel for a battery compartment to change batteries. Furthermore, USB buffer interface 330 may allow other devices to connect to the control system 335 to obtain data from the motion sensor 355 and/or the volume sensor 345. In accordance with some embodiments, the power supply may be charged by a wireless charging system that charges the power supply when cap 120 is proximate a wireless power emitter.

Figure 5:
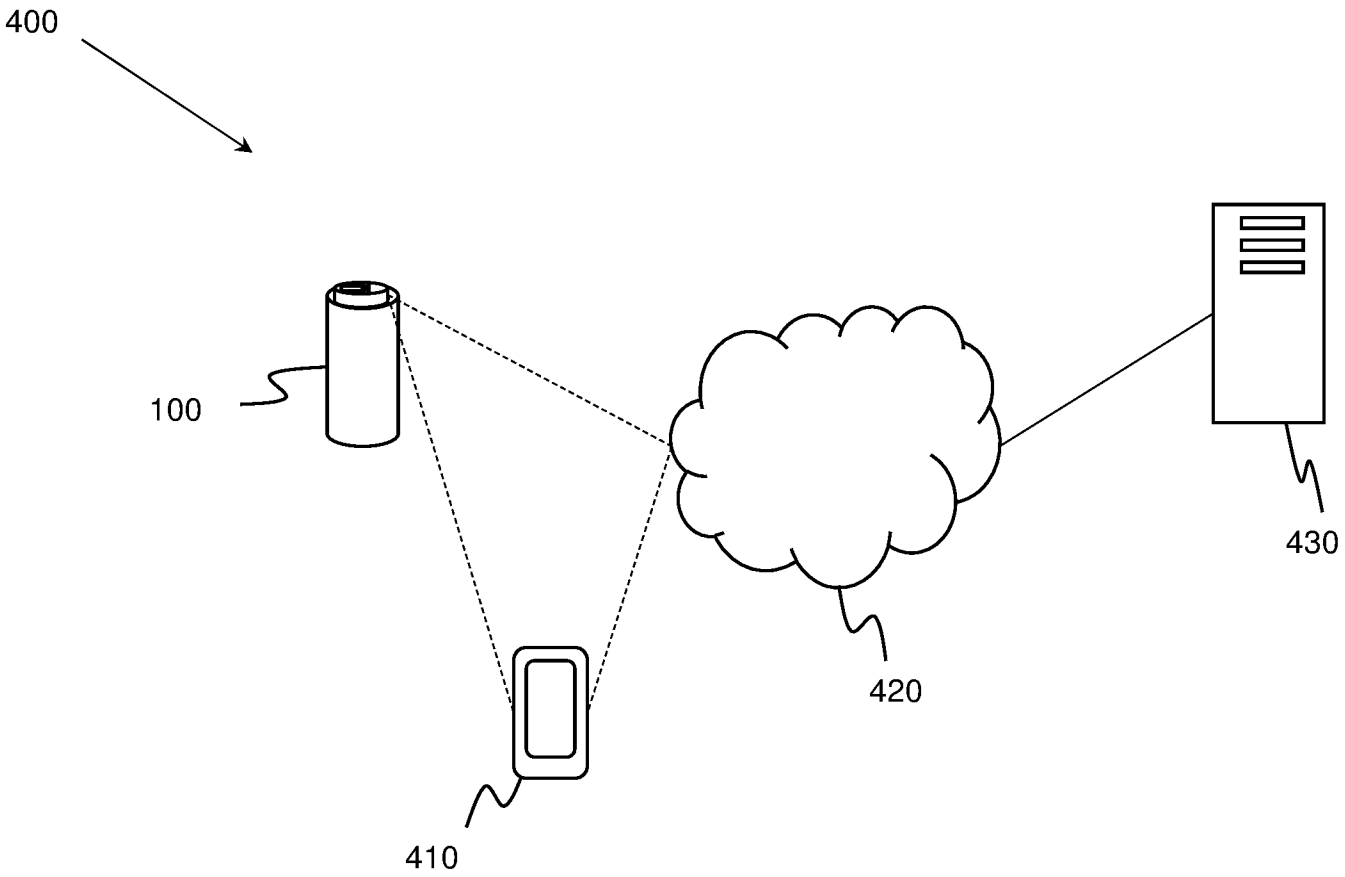
FIG. 5 illustrates a schematic view of a container in electronic communication with various distal devices, including cloud-based storage or network-connected devices.

FIG. 5 illustrates a schematic view of a container 100 in electronic communication with various distal device, such as mobile device 410, network 420, and server 430. As stated above, the cap 120 of the container 100 can comprise a memory that saves a tally of actions that have been performed by the cap 120, such as how many times a spout has been opened or closed, or how much liquid has been sent through the spout. In some embodiments, a transmitter of the cap 120 could be configured to communicate with a mobile device 410, such as a phone, a PDA, or a laptop, which could read data from a memory located with the cap 120. For example, an app could be installed on the mobile device 410 which is configured to communicate with the transmitter of the cap 120 via Bluetooth and transmit a request to send data saved on the memory to the mobile device 410. The app could then display on the mobile device 410 tally information, such as how many times a spout has been opened, or how much liquid has been sent through a spout. In some embodiments, the app could also be configured to transmit a signal to the processor of the cap 120 to reset a tally memory. Such an embodiment allows a user of the mobile device 410 to reset a tally memory and to read a tally memory saved on the memory of the cap 120. While the mobile device 410 is shown as wirelessly communicating with a transmitter of the cap 120, in some embodiments the mobile device 410 could communicate with a transmitter of the cap 120 via a wire that is plugged into both the mobile device 410 and the cap 120.

In some embodiments, the cap 120 could be configured to automatically transmit data to a server 430 via a network 420, such as the Internet. In such embodiments, the cap 120 could be configured to automatically transmit tally memory data to the server 430 periodically, such as every 10 minutes, every hour, or every day. Such time increments could be predefined, or such time increments could be defined by an admin user that communicates with the cap 120 via a transmitter, such as a user of the mobile device 410. In such embodiments, a user of the mobile device 410 could choose to read the tally memory by reading the tally memory directly from a transmitter of the cap 120, or by transmitting a query to the server 430 via the network 420. In some examples, a dashboard can be provided on a webpage that a user can then use to view various metrics about the activities of the cap. In such embodiments, the server 430 could be configured to provide a web server or other portal that a client device, such as a desktop computer or the mobile device 410, could functionally connect to in order to receive data collected on the container 100. Such a dashboard could provide, for example, data in a numerical or a graph form to a user to indicate usage statistics collected over time.

Broadly speaking, the present invention is directed to a cap with automatic flow path operation and to a water bottle having a container and a cap with automatic flow path operation. The cap can include a spout and a mechanism for opening and closing a flow path through the cap, such as, but not limited to, a cover, a gate, a linkage, a valve, and/or a squeezing mechanism for pinching a line. The cap system can further include an electrical drive mechanism for moving the mechanism for opening and closing the flow path. For example, the electrical drive mechanism can be a stepper motor, a servo motor, or an actuator that moves or manipulates the cover or gate, either directly or indirectly, to open or close the flow path. The cap system can further include one or more sensors, a control system, a power supply, and any one or more of the other features discussed elsewhere herein.

The methods of use and methods of making the container apparatus and components as described herein are also within the scope of the present invention. Although the invention has been discussed with respect to various embodiments, it should be recognized that the invention comprises the novel and non-obvious claims supported by this disclosure.

What is claimed is:

1. A cap for a water bottle comprising:

a base comprising a top surface and a bottom surface;

a flow path through from the bottom surface to the top surface;

a spout on the top surface of the base having a throughput, wherein the spout has a closed position that seals the throughput from the flow path and has an open position that allows fluids to flow from the flow path via the throughput out the spout;

an intake tube in fluid communication with the throughput;

a state sensor that is configured to trigger a pump when the state sensor senses a state change of a portion of the cap; and wherein the pump is configured to draw liquid through the intake tube towards the throughput.

2. The cap of claim 1, wherein the state sensor comprises an accelerometer configured to trigger an actuator to move the spout to the open position when the accelerometer senses when the portion of the cap is tilted from a horizontal plane by more than a first threshold amount.

3. The cap of claim 2, wherein the accelerometer is configured to trigger the actuator to move the spout to the closed position when the accelerometer senses when the portion of the cap is tilted to be level with the horizontal plane within a second threshold amount.

4. The cap of claim 1, further comprising a fingerprint scanner that is configured to activate the state sensor when the fingerprint scanner recognizes a fingerprint.

5. The cap of claim 1, further comprising a use tally memory configured to increment when the actuator moves the spout to the open position.

6. The cap of claim 1, further comprising:

a volume tally memory; and a volume sensor that increments a volume tally saved on the volume tally memory when the volume sensor senses fluid flow from the flow path via the throughput out the spout.

7. The cap of claim 6, further comprising a wireless transceiver that is configured to transmit the volume tally saved on the volume memory to an electronic device remote from the cap.

8. A system for controlling throughput of a container, comprising:

a cap coupled to the container having a flow path from an interior volume of the container to an exterior area of the container;

a spout extending from the cap, the spout comprising a throughput, an opening at an end of the spout, a closed position that seals the throughput from the flow path, an open position that allows fluids to flow from the flow path to the opening of the spout via the throughput, and an intake tube in fluid communication with the throughput;

a pump fluidly connected to the intake tube;

a state sensor that senses a state change of a portion of the cap;

a memory having instructions saved on the memory; and a processor configured to execute the instructions saved on the memory to activate the pump when the processor receives a state change signal from the state sensor.

9. The system of claim 8, wherein the state sensor comprises an accelerometer that is configured to trigger a first state change when the accelerometer senses when the portion of the cap is tilted by more than a first threshold amount from a reference angle.

10. The system of claim 9, wherein the accelerometer is configured to trigger a second state change when the accelerometer senses when the portion of the cap is tilted by less than a second threshold amount from the reference angle.

11. The system of claim 8, further comprising a fingerprint scanner is configured to register a fingerprint disposed in a scanning area of the fingerprint scanner, wherein the processor is further configured to execute the instructions saved on the memory to trigger an actuator when the processor recognizes the fingerprint as an authorized fingerprint.

12. The system of claim 8, wherein the processor is further configured to execute the instructions saved on the memory to increment a use tally saved on the memory when the actuator moves the spout to the open position.

13. The system of claim 12, further comprising a wireless transceiver, wherein the processor is further configured to execute the instructions saved on the memory to transmit the tally to an electronic device remote from the cap.

14. The system of claim 8, further comprising a volume sensor configured to sense fluid flow through the cap when the spout is in the open position, wherein the processor is further configured to execute the instructions saved on the memory to increment a volume saved on the memory when fluids flow through the cap.

* * * * *